US005445179A

United States Patent [19]

Di Lullo et al.

[11] Patent Number: 5,445,179

[45] Date of Patent: Aug. 29, 1995

[54] PROCESS FOR RECOVERING AND CAUSING HIGHLY VISCOUS PETROLEUM PRODUCTS TO FLOW

[75] Inventors: Alberto Di Lullo; Armando Marcotullio, both of Milan; Enrico Borgarello, Turin, all of Italy

[73] Assignees: Eniricerche S.p.A.; AGIP S.p.A., both of Milan, Italy

[21] Appl. No.: 193,051

[22] PCT Filed: Jul. 3, 1993

[86] PCT No.: PCT/EP93/01775

§ 371 Date: Mar. 3, 1994

§ 102(e) Date: Mar. 3, 1994

[87] PCT Pub. No.: WO94/01684

PCT Pub. Date: Jan. 20, 1994

[30] Foreign Application Priority Data

Jul. 6, 1992 [IT] Italy ..... MI92A1643
Jul. 15, 1992 [IT] Italy ..... MI92A1712

[51] Int. Cl.[6] ..... F17D 1/17; C10L 1/32

[52] U.S. Cl. ..... 137/13; 507/259; 507/937

[58] Field of Search ..... 137/13; 252/8.551, 8.554; 507/259, 937

[56] References Cited

U.S. PATENT DOCUMENTS

| | | | |
|---|---|---|---|
| 4,246,920 | 1/1981 | McClaflin | 137/13 |
| 4,514,189 | 4/1985 | Papalos et al. | 44/51 |
| 4,565,546 | 1/1986 | Ohzeki et al. | 44/51 |
| 4,725,287 | 2/1988 | Grogoli et al. | 137/13 X |
| 4,949,743 | 8/1990 | Broom | 137/13 |
| 5,013,462 | 5/1991 | Danley | 137/13 X |

FOREIGN PATENT DOCUMENTS

| | | |
|---|---|---|
| 0092142 | 10/1983 | European Pat. Off. . |
| 0093883 | 11/1983 | European Pat. Off. . |
| 0237724 | 9/1987 | European Pat. Off. . |
| 0244902 | 11/1987 | European Pat. Off. . |
| 0379749 | 8/1990 | European Pat. Off. . |
| 0450201 | 10/1991 | European Pat. Off. . |
| 0457375 | 11/1991 | European Pat. Off. . |
| 57-92090 | 6/1982 | Japan . |
| 1247492 | 10/1989 | Japan . |

*Primary Examiner*—John Rivell
*Attorney, Agent, or Firm*—Oblon, Spivak, McClelland, Maier, & Neustadt

[57] ABSTRACT

Process for recovering and causing highly viscous petroleum products to flow by means of an aqueous dispersion of the petroleum product, in which the dispersant is selected from alkali metal or ammonium salts of organic sulfonates having the following properties: (A) sulfur content of at least 10%; (B) water solubility at 20° C. of at least 15% by weight; (C) decrease in water surface tension, at a concentration of 1% by weight, not higher than 10%.

11 Claims, 8 Drawing Sheets

PROCESS FOR RECOVERING AND CAUSING HIGHLY VISCOUS PETROLEUM PRODUCTS TO FLOW

BACKGROUND OF THE INVENTION

The present invention relates to an improved process for recovering and causing highly viscous petroleum products to flow through drilled well bores or pipelines.

Causing highly viscous petroleum products or residues, in particular those with an API grade lower than 15, to flow through ducts is difficult owing to their high viscosity and consequently poor flowing ability.

A method for improving the flowing ability of, and recovering, these highly viscous products consists in adding lighter crude petroleum grades or hydrocarbons to said products. This blending decreases the viscosity of the system and hence increases the flowing ability thereof, but displays the drawback of requiring considerably high investment costs and consequently is rather expensive. Furthermore, not always light fractions or crude petroleum grades are available.

Another method for improving the fluidity of highly viscous products inside the pipelines, consists in installing heating means at frequent intervals along the pipeline; in that way, the so heated crude or petroleum product has a low viscosity and, therefore, conveying it is easier. These heating means can be operated by using a portion of conveyed product as fuel. This technique may result in the loss of 15–20% of transported product.

Another method for conveying heavy petroleum products or residues through pipelines consists in pumping them through the pipeline as more or less fluid aqueous emulsions. Said emulsions are of oil-in-water (O/W) type and therefore are decidedly more fluid than the crude petroleum to be conveyed.

The oil-in-water emulsions, prepared by adding, with stirring, water and an emulsifier to the oil to be conveyed, are then pumped into the pipeline.

The emulsifier agent should produce a stable and fluid oil-in-water emulsion with a high oil level.

For the process to be advantageous, it is necessary that the emulsifier agent is cheap and capable of generating emulsions which are stable during the pumping period.

The emulsifiers proposed heretofore are not fully compliant with the above said requisites.

For example, U.S. Pat. Nos. 4,246,920, 4,285,356, 4,265,264 and 4,249,554 disclose emulsions which contain an oil level of only 50%; under these conditions, this means that half volume of the pipeline is unavailable for transporting petroleum.

On the other hand, the Canadian patent Nos. 1,108,205; 1,113,529 and 1,117,568, as well as U.S. Pat. No. 4,246,919 disclose rather small decreases in viscosity, notwithstanding the relatively low oil proportion.

U.S. Pat. No. 4,770,199 discloses, on the contrary, emulsifier agents which are constituted by complex blends of non-ionic alkoxylated surfactants with carboxylated ethoxylated-propoxylated species. The non-ionic surfactant contained in the above said blend obviously is sensible to temperature, and consenquently it may become insoluble in water under determined temperature conditions. Furthermore, the above said surfactants are very expensive and contribute to increase the process costs.

Finally, EP-B-237,724 uses, as emulsifier agents, mixtures of carboxylated ethoxylates and sulfate ethoxylates, products not easily available on the market, and rather expensive.

SUMMARY OF THE INVENTION

Therefore, a purpose of the present invention is a process for recovering and causing very viscous petroleum products to flow, which process overcomes, or at least partially reduces, the above said drawbacks which affect the prior art.

In accordance therewith, a first aspect of the present invention relates to a process for recovering and causing highly viscous petroleum products to flow, characterized in that the above said high-viscosity petroleum products are recovered and caused to flow as aqueous dispersions wherein the water content of said dispersions is of at least 15%, said dispersions being formed by bringing said high-viscosity petroleum products into contact with an aqueous solution of a sulfonate dispersant selected from one or more of alkali metal or ammonium organic sulfonates having, with reference to the sodium salts of said sulfonates, the following properties:

(A) a sulfur content of at least 10%, preferably comprised within the range of from 11 to 18%;

(B) a water solubility at 20° C. of at least 15% by weight, preferably comprised within the range of from 20 to 60% by weight;

(C) a decrease in water surface tension, at a concentration of 1% by weight, not higher than 10%, usually not higher than 8%;

By "highly viscous" or "high-viscosity" petroleum products, very highly viscous crude petroleum grades, which cannot be extracted from the wells by means of the usual technologies, or petroleum residues from any sources, for example atmospheric residues or vacuum residues, are meant. In any cases, the above said very viscous petroleum products will have an API gravity lower than 15° and a viscosity at 30° C. higher than 40 000 mPas.

The above listed properties (i.e., solubility in water, very small decrease in water surface tension, sulfur content) inequivocally differentiate the sulfonated dispersants from the usual sulfonated surfactants. The latter display completely different properties, i.e., poor water solubility, considerable decrease in water surface tension, and a sulfur content which is often lower than 10%. In particular the first two mentioned properties are of basic importance in order to differentiate a dispersant from a surfactant.

Typical examples of sulfonate dispersants which meet the above requirements are the products deriving from the condensation of (alkyl)napthalene sulfonic acid and formaldehyde, sulfonated polystyrenes, lignosulfonates, the oxidative sulfonation products obtained by treating special aromatic fractions with sulfur trioxide.

In general, the organic sulfonates displaying dispersant properties are substances with a higher molecular weight than 1000. Owing to their considerably high solubility in water and the presence of inorganic (usually sulfate) salts, a precise determination of their molecular weight meets with serious difficulties.

However, the above said dispersant sulfonates inherently have a high molecular weight (e.g., ligno sulfonates), or are prepared by means of processes leading to increases in molar weight. For example, well known are those commercial dispersants which are obtained from the condensation of (alkyl)naphthalene sulfonic acid with formaldehyde.

By the expression "(alkyl)naphthalenesulfonic acid", either a naphtalenesulfonic acid or an alkyl naphthalenesulfonic acid, or their mixtures, are meant, in which from one to three hydrogen atoms in the naphthalene moiety are replaced by a same number of $C_1$–$C_4$ alkyl radicals.

The above said formaldehyde-naphthalene sulfonic acid condensate is an easily found product on the market; moreover, various types are available which are different due to their molecular weight, or, practically, their different ratio of naphthalene sulfonic acid to formaldehyde with which they are prepared.

The salts of (alkyl)naphthalene sulfonic acid condensates with formaldehyde ("CANF's") are prepared by causing sulfuric acid to react with (alkyl) naphthalene acid and subsequently condensing the resulting (alkyl) naphthalene sulfonic acid with formaldehyde.

The ratio of formaldehyde to (alkyl) naphthalenesulfonic acid is critical, because a low value of such a ratio causes a inadequate degree of polymerization to be achieved, and a too high value of said ratio causes the condensate to undergo a crosslinking process, with the resulting product consequently turning into an insoluble one both in water and in oil.

A typical CANF preparation is reported in Ulmann's Encyclopedia of Industrial Chemistry, Fifth Ed., Vol. A8, page 587.

Obviously, products deriving from mixtures of naphthalene and alkylnaphthalenes; or from naphthalene grades having a purity level lower than 100%, and anyway not lower than 85%, will operate in an as effective way.

Sulfonate dispersants displaying the above disclosed characteristics are also those which are prepared by means of processes of "oxidative sulfonation" of particular fractions, of prevailingly aromatic character. The expression "oxidative sulfonation" is used herein in order to refer to a process in which, by treating the above said fractions with $SO_3$, not only a sulfonation, but also an increase in molecular weight results.

The above said process, disclosed in EP-A-379,749, consists of:

bringing sulfur trioxide in either liquid or gas form, into contact with a solution of fuel oil from stream cracking in $SO_2$, with a ratio, by weight, of $SO_3$ to fuel oil comprised within the range of from 0.7:1 to 1.7:1 and a ratio, by weight, of $SO_2$:$SO_3$ comprised within the range of from 0.5:1 to 10:1, at a temperature comprised within the range of from 0° to 120° C., until a complete or substantially complete conversion of $SO_3$ is obtained;

removing, by evaporation, sulfur dioxide from the sulfonated fuel oil;

neutralizing the sulfonated fuel oil with an aqueous solution of an alkali metal or ammonium hydroxide;

recovering the neutralized sulfonated dispersant.

The term "fuel oil from steam cracking" is used herein in order to refer to the high-boiling liquid residue deriving from naphtha and/or gas oil cracking used to produce light olefins, in particular ethylene. This fuel oil did not find any valuable commercial uses, and its price is presently computed on a calories base.

Most ethylene is produced worldwide by cracking gas oil and/or naphtha in the presence of steam (see Ulmann's Encyclopedia of Industrial Chemistry, Vol. A10, page 47).

The reaction byproducts are partially constituted by such gases as hydrogen, methane, acetylene, propane and so forth; liquid fractions with boiling point comprised within the range of from 28° to 205° C.; and, finally, by a high-boiling residue, the so-said "fuel oil from steam cracking" ("FOK").

This fuel oil is formed with variable yields according to the operating conditions of the cracker and, above all, as a function of the type of feedstock. The yields of fuel oil typically are of 15–20% when the cracker is fed with gas oil, and of 2–5% when naphtha is fed. Also the chemical composition of the resulting fuel oil may display minor changes as a function of said parameters. In any case, such a product contains a minimum content of 70% of aromatics, usually comprised within the range of from 80 to 90%, as determined by column cromatography according to ASTM D 2549, with the balance to 100 being constituted by saturated and polar species.

FOK's aromatic portion is constituted by at least 75%, by aromatic and alkyl aromatic species with two or more fused rings.

At least 50% of FOK boils at a lower temperature than 340° C. ("340° C.-"); in general, FOK's carbon content is higher than 80%; and FOK's density at 15° C. is of 0.970 kg/dm$^3$.

FOK is dissolved in sulfur dioxide, and the resulting solution is brought into contact with sulfur trioxide in either liquid or gas form. In particular, the reaction is carried out at temperatures comprised within the range of from 0° to 120° C., under such pressures as to keep the reaction mixture in the liquid phase and generally of from 1.5 to 45 bars, with a ratio, by weight, of sulfur trioxide to FOK comprised within the range of from 0.7:1 to 1.7:1. while simultaneously stirring the reaction mixture. Operating at higher temperatures than 120° C. is disadvantageous, because sulfonate dispersants with not completely satisfactory characteristics are obtained.

DESCRIPTION OF THE PREFERRED EMBODIMENT

Figure 1:
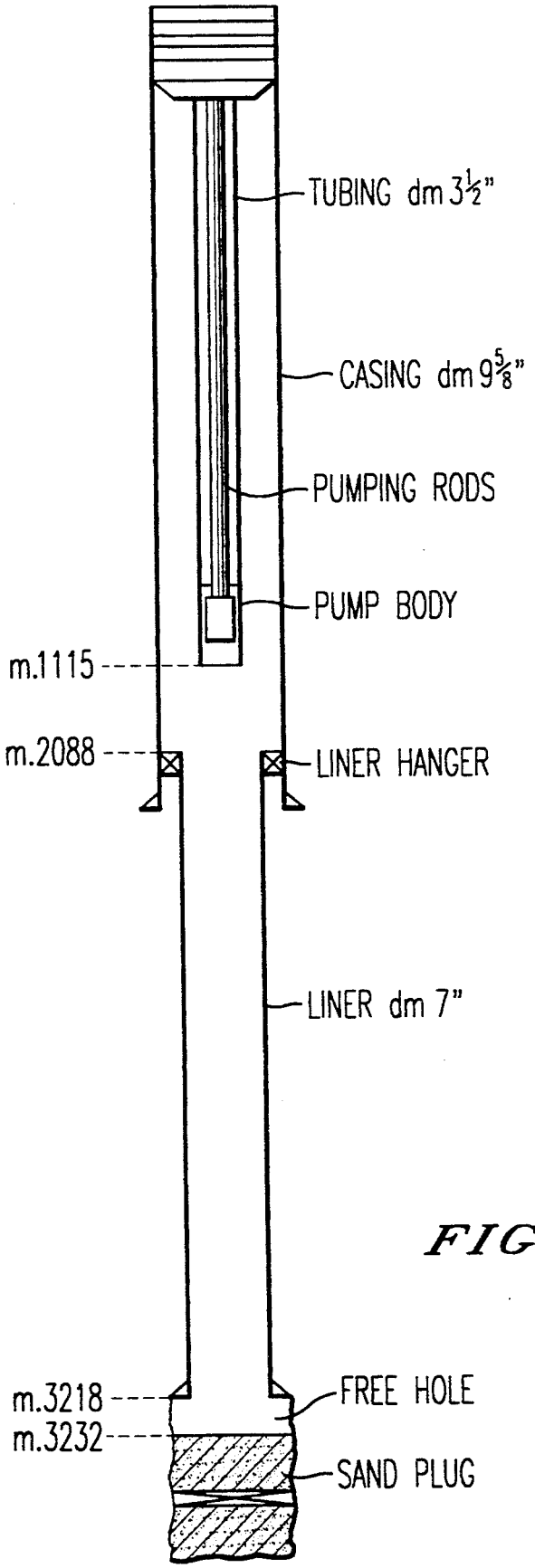
FIG. 1 is a schematic flow diagram of a GELA 105 Well.

In the preferred embodiment, the reaction temperature is of from 20° to 100° C., with a ratio, by weight, of sulfur trioxide to FOK comprised within the range of from 0.8:1 to 1.6:1. Advantageously, FOK concentration in the solution is kept at 20–50%, with sulfur trioxide being gradually added to the reaction mixture.

The required reaction times in order to achieve a complete, or substantially complete, conversion of sulfur trioxide are generally comprised within the range of from 10 to 120 minutes, and typically are of the order of 70 minutes.

At the end of the sulfonation, sulfur dioxide is removed from the reaction mixture by reducing the pressure and optionally flowing an inert gas stream (e.g., nitrogen) through the reaction mixture, in order to remove any last traces of sulfur dioxide. Advantageously, during the removal of sulfur dioxide, the reaction mixture is kept at temperatures of the same order of magnitude as used during the sulfonation step. So separated sulfur dioxide may be recycled, after being preliminarily condensed, to the sulfonation step, or it can be sent to another use, e.g., to a sulfuric acid production facility. In any cases, sulfur dioxide displays a high enough purity level as not to require any preliminary purification treatments.

Sulfonated FOK obtained after separating sulfur dioxide, is salified by means of a treatment with an aqueous solution of an alkali metal or ammonium, preferably aqueous sodium hydroxide.

The resulting product has a molecular weight (MW), as determined by gel permeation in aqueous phase with two coupled detectors (refractive index and differential viscometer) which indicatively is of from 10,000 to 40,000, according to the experimental conditions. The above said increase in molecular weight is due to the oxidizing—besides sulfonating—power of $SO_3$ under the reaction conditions.

In that way, an aqueous solution is obtained of the sulfonated dispersant, which is constituted (based on dry matter) by 75–85%, by sulfonated organic species containing, on an average, from 0.35 to 0.70 mols of sulfonic moieties per each 100 g of organic sulfonate, with the residual content being sulfate or sulfite, besides small amounts of crystal water.

Going back to the process according to the present invention, the term "dispersion" is applied herein to a multiphase system in which one phase is continous and at least another phase is finely dispersed.

By the term "dispersant", products or product blends are meant which promote the formation of a dispersion or stabilize a dispersion.

In the dispersion according to the present invention, the continuous phase is water and the dispersed, finely distributed, phase is constituted by the particles, probably of both solid and liquid character, of heavy petroleum product.

The aqueous dispersions of the present invention are stabilized, by a prevailingly electrostatic mechanism, by the dispersants prepared in the above disclosed way.

The ratio of the petroleum product to water by weight may vary within a wide range, for example of from 90:10 to 10:90. Of course, due to obvious economic reasons, the use is preferred of high levels of petroleum residue, which however could result in the resulting dispersions disadvantageously having excessively high viscosity values.

An optimal composition of the dispersion, which is a function of the type of product to be caused to flow, will contain a water level comprised within the range of from 15 to 40%, relatively to the total dispersion weight.

Also the dispersant amount is a function of the type of product to be caused to flow; in any case, the dispersant level which is necessary in order to have a stable and fluid dispersion is comprised within the range of from 0.2 to 2.5%, preferably of from 0.4 to 1.5%, with all said percent values being based on the amount of dispersant agent relatively to the total amount of water and petroleum product.

The aqueous dispersion of the heavy petroleum product can be accomplished as follows:

First of all, the salt, preferably the sodium salt, of the sulfonated dispersant, is dissolved in water.

The aqueous solution of the dispersant is then added to the petroleum product to be caused to flow and the dispersion is prepared by stirring the resulting phases by means of a turbine, or with a paddle stirrer, or with centrifugal pumps.

In the case of the exploitation of petroleum wells containing heavy crude petroleum grades which cannot be caused to flow by means of the usual technologies, the crude petroleum can be recovered by means of the above procedure.

In particular, the aqueous solution of the dispersant to be injected into the well in such a way that it comes into contact with petroleum at a deeper depth than of the recovery pump, or equal to it.

In that case, the mechanical mixing action produced by the pump will be enough to produce a flowing dispersion at wellhead.

In this regard, it may prove useful to underline that the good rheological properties necessary for an effective recovery of petroleum as an aqueous dispersion are neither depending on the homogeneity of the dispersion, nor from the size of (solid or liquid) particles dispersed in the water phase.

In other words, the process according to the present invention does not require any particular mixing forms, nor is it bound to a particular size of the dispersed particles. In fact, the crude petroleum can be caused to flow and recovered also in the event when the dispersed heavy oil is in the form of particles with macroscopic size.

The dispersions according to the present invention are very storage stable also over long storage times (in fact, no phase separation was observed even after some hour hundreds of hours).

In that way, the above said dispersion can be stored as desired inside suitablè tanks and then it can be transferred to the pipeline or to the tanker at the right time.

Furthermore, this technique consisting of recovering or causing said heavy petroleum products to flow by using an aqueous dispersion displays further advantages resulting from low cost products, which can be obtained by starting from largely available raw materials, being used as the dispersants.

Finally, as these very highly water soluble dispersants, differently from the usual surfactants, do not cause a considerable decrease in water surface tension, no additions are required of antifoaming agents to the aqueous dispersions of petroleum residue of the present invention.

The following examples are reported in order to better illustrate the present invention.

EXAMPLES

In order to demonstrate the dispersing properties of the compounds according to the present invention, experiments were carried out on two very viscous petroleum products from different origins.

The first one is a "Gela" crude petroleum displaying the following characteristics: API grade 9; viscosity in its pristine state 120 000 mPas, and, after dilution with 30% of 800 mPas gas oil, at 30° C.

The second product is a +370° C. distillation residue "Belaym" crude, with API grade 13, and a viscosity of 80 000 mPas at 30° C.

The dispersions were prepared by adding the petroleum product, heated up to a temperature of approximately 60° C. in order to flux it, to an aqueous solution of the dispersant agent and subsequently stirring the resulting mixture with a turbine stirrer at approximately 10 000 rpm for a time comprised within the range of from 10 to 50 seconds.

The resulting dispersions were left standing at room temperature (about 20°–22° C.). From time to time, the dispersions were checked for phase separation and the rheological characterization of the dispersions was carried out.

In order to carry out these measurements (the results of which are reported in Table 1) a rheometer Haake RV12 with couette geometry was used (model MVI P, bob radius 20.04 mm, torque radius 21.00 mm, bob height 60 mm), with a knurled bob so as to reduce the slipping phenomena typical of materials displaying yield stress. The bob bottom is displaced backwards, in such a way that during the introduction of said bob into the dispersion, an air bubble is retained which is capable of minimizing the edge effects. All measurements were carried out at 30° C., only using samples capable of wetting the metal of the bobcouette system and which did not result to have undergone phase separation.

The stress measurements were carried out by increasing the shear rate up to the constant value of 100 $sec^{-1}$ within a very short time (5 seconds), and following the stress changes over time under constant shear conditions.

Within a very short time, the viscosity reaches a constant value which is reported in Table 1.

The yield stress, i.e. the minimal stress which is necessary in order to cause a mass of fluxed crude petroleum to start flowing, was calculated by extrapolations. The method used is based on Casson's model, which consists in preparing a chart showing the square root of stress as a function of the root square of shear rate and linearly extrapolating the resulting curve down to zero shear rate value. The square of the intercept value at shear rate 0 supplies the desired yield stress value.

EXAMPLES 1–8

In these Examples, the dispersant used is the sodium salt of the condensate of naphthalene sulfonic acid with formaldehyde (sulfur content: 13.2%). The surface tension of an 10% aqueous solution thereof at 25° C. is of 70.5 dyne/cm, vs. the value of 71.5 dyne/cm of pure water. The water solubility of said dispersant at 20° C. is of approximately 44.5%.

Example 8 should be regarded as a Comparison Example, because at these levels of dispersant concentration a stable suspension is obtained which is too highly viscous to be pumped by means of usual pumps.

TABLE 1

| Example No. | Crude Oil (type) | Disp., %-w* | $H_2O$ %-w | Time, hours | Viscosity mPas | Yield Pa |
|---|---|---|---|---|---|---|
| 1 | Gela | 0.4 | 29.8 | 120 | 670 | 1.6 |
| " | " | " | " | 408 | 450 | 1.0 |
| 2 | Gela | 0.6 | 30.0 | 120 | 390 | 0.5 |
| " | " | " | " | 384 | 310 | 0.6 |
| 3 | Gela | 1.5 | 29.6 | 72 | 270 | 0.7 |
| " | " | " | " | 264 | 400 | 1.0 |
| 4 | Gela | 1.5 | 29.5 | 72 | 260 | 0.9 |
| " | " | " | " | 288 | 340 | 1.1 |
| 5 | Gela | 2.4 | 29.6 | 96 | 220 | 0.7 |
| " | " | " | " | 288 | 220 | 0.5 |
| 6 | Gela | 0.9 | 36.3 | 72 | 100 | 0.3 |
| " | " | " | " | 288 | 110 | 0.4 |

TABLE 1-continued

| Example No. | Crude Oil (type) | Disp., %-w* | $H_2O$ %-w | Time, hours | Viscosity mPas | Yield Pa |
|---|---|---|---|---|---|---|
| 7 | Belaym | 1.0 | 29.8 | 96 | 195 | 0.3 |
| " | " | " | " | 288 | 185 | 0.3 |
| 8 | Gela | 0.1 | 29.9 | 120 | 960 | 1.0 |
| " | " | " | " | 384 | 1000 | 2.6 |

%-w = % by weight

The test of Example 4 was carried out by adding the aqueous solution of the dispersant to the petroleum residue. The results, nearly equivalent to those of Example 3, demonstrate that both said methods for preparing the dispersion are equivalent.

EXAMPLES 9–12

By operating according to the same procedure as disclosed in Example 1, dispersions are prepared by using the dispersants disclosed in EP-A-379,749, obtained by sulfonating with $SO_3$ the fuel oil from steam cracking produced at the cracker of Priolo (Sicily) (referred to in the following, for the sake of simplicity, as "FOKP") and neutralizing the resulting sulfonate with aqueous NaOH.

In particular in Example 9 a dispersant is used which is prepared under the following conditions: $SO_2/SO_3$/-FOKP ratios=1.47:0.80:1, temperature during $SO_3$ addition comprised within the range of from 21° to 37° C. and end temperature about 80° C. The dispersant is used in its pristine state, with a content of 79% of active species, with the balance to 100 being constituted by 16.3% by weight of sulfates and sulfites and 4.7% of crystal water.

In Example 10 a dispersant is used which is produced under the following conditions: $SO_2/SO_3$/FOKP ratios=1.48:1.49:1, temperature during $SO_3$ addition comprised within the range of from 11° to 33° C. and end temperature 100°–109° C. The dispersant is used in its pristine state, with a content of 70% of active species, with the balance to 100 being constituted by 25.2% by weight of sulfates and sulfites and 4.8% of crystal water.

In Example 11 a dispersant is used which is produced under the following conditions: $SO_2/SO_3$/FOKP ratios=1.48:1.29:1, temperature during $SO_3$ addition comprised within the range of from 15° C. (initial temperature) up to a maximum of 111° C. The dispersant is used in its pristine state, with a content of 72.9% by weight of active species, with the balance to 100 being constituted by 22.1% of sulfates and sulfites and 5.0% of crystal water.

In Example 12 a dispersant is used which is produced under the following conditions: $SO_2/SO_3$/FOKP ratios=1.55:0.97:1, temperature during $SO_3$ addition comprised within the range of from 12° to 36° C. during the addition of $SO_3$, and end temperature comprised within the range of from 79° to 83° C. The dispersant is used in its pristine state, with a content of 79.6% by weight of active species, with the balance to 100 being constituted by 14.8% of sulfates and sulfites and 5.6% of crystal water.

All the dispersants prepared according to as disclosed in EP-A-379,749 contain 11.6–13.8% of sulfur, have a water solubility of from 41 to 47%, and cause a decrease in water surface tension comprised within the range of from 3 to 8%.

In table 2, the numbers relate to different dispersants and the letters relate to different formulations.

TABLE 2

| Example No. | Crude Oil (type) | Disp., %-w* | $H_2O$ %-w | Time, hours | Viscosity mPas | Yield Pa |
|---|---|---|---|---|---|---|
| 9a | Gela | 1.0 | 29.5 | 264 | 800 | 2.0 |
| " | " | " | " | 576 | 1150 | 2.0 |
| " | " | " | " | 1464 | 1300 | 2.0 |
| 9b | " | 0.6 | 30.0 | 50 | 250 | 1.0 |
| 10a | Gela | 0.3 | 30.1 | 144 | 640 | 0.4 |
| " | " | " | " | 384 | 500 | 1.7 |
| 10b | " | 0.6 | 29.7 | 72 | 190 | 0.0 |
| " | " | " | " | 288 | 205 | 0.2 |
| 10c | " | 1.0 | 30.3 | 24 | 70 | 0.0 |
| " | " | " | " | 312 | 93 | 0.0 |
| " | " | " | " | 912 | 75 | 0.0 |
| 10d | Belaym | 1.0 | 30.0 | 96 | 285 | 0.2 |
| " | " | " | " | 288 | 205 | 0.0 |
| 11a | Gela | 0.6 | 30.0 | 50 | 290 | 0.0 |
| 11b | " | 1.0 | 29.4 | 264 | 270 | 0.0 |
| 11b | Gela | 1.0 | 29.4 | 576 | 340 | 0.0 |
| " | " | " | " | 1464 | 260 | 0.0 |
| 11c | " | 1.0 | 29.9 | 600 | 200 | 0.0 |
| " | " | " | " | 936 | 230 | 0.0 |
| " | " | " | " | 1008 | 290 | 0.0 |
| 11d | " | 1.0 | 30.2 | 600 | 150 | 0.0 |
| " | " | " | " | 936 | 150 | 0.5 |
| " | " | " | " | 1008 | 140 | 0.0 |
| 12a | " | 0.6 | 30.0 | 50 | 290 | 0.3 |

* %-w = % by weight

From these data, the fluxing properties of the above disclosed sulfonates and the storage stability of the resulting dispersions can be appreciated.

EXAMPLE OF AN ON-FIELD PRODUCTION TEST

In the instant Example, the trend of the production test is reported, which is carried out by using an aqueous dispersion is reported, which was carried out on GELA 105 well.

The situation of the well GELA 105 is.

FIG. 1 is a schematic illustration of Well GELA 105. The Well GELA 105 comprises 9"⅝ diameter CASING which extends from the surface of the well to a depth of 2088 m and which encloses a 3"½ diameter TUBING. Inside the tubing is installed a PUMP BODY at a depth of 1115 m. The pump body is connected to PUMP RODS which extend from the pump body to the surface of the well. The casing is connected to a 7" diameter LINER by the LINER HANGER at a depth of 2088 m. The liner extends to a depth of 3218 m, and is followed by a FREE HOLE. At a depth of 3232 m the well is plugged by the SAND PLUG.

Well GELA 105 is a producer of a heavy oil grade, which is fluxed by means of the injection of gas oil at a level of 10% by volume, based on the crude oil, into the annular region comprised between the tubing and the casing and artificially recovered by a rod pump installed at 1115 m of depth and actuated by a surface unit of conventional type. The net oil production under conditions of fluxing with gas oil is of approximately 30 $m^3$ per day.

The test of production with the water dispersion was carried out without supplying any modifications to the well completion and in order to perform the test, the gas oil was replaced by an aqueous dispersant solution injected at such a flow rate as to obtain a theoretical O/W ratio of 70:30.

Aiming at altering as negligibly as possible the conditions of the well, we additionally tried to keep constant the net oil throughput. For that purpose, before replacing the gas oil with the aqueous solution of the dispersant, the stroke of the plunger of the rod pump was increased from 70 inches up to 85 inches, with an increase in theoretical oil throughput from 28 $m^3$ per day up to 39.5 $m^3$ per day being obtained.

Figure 2A:
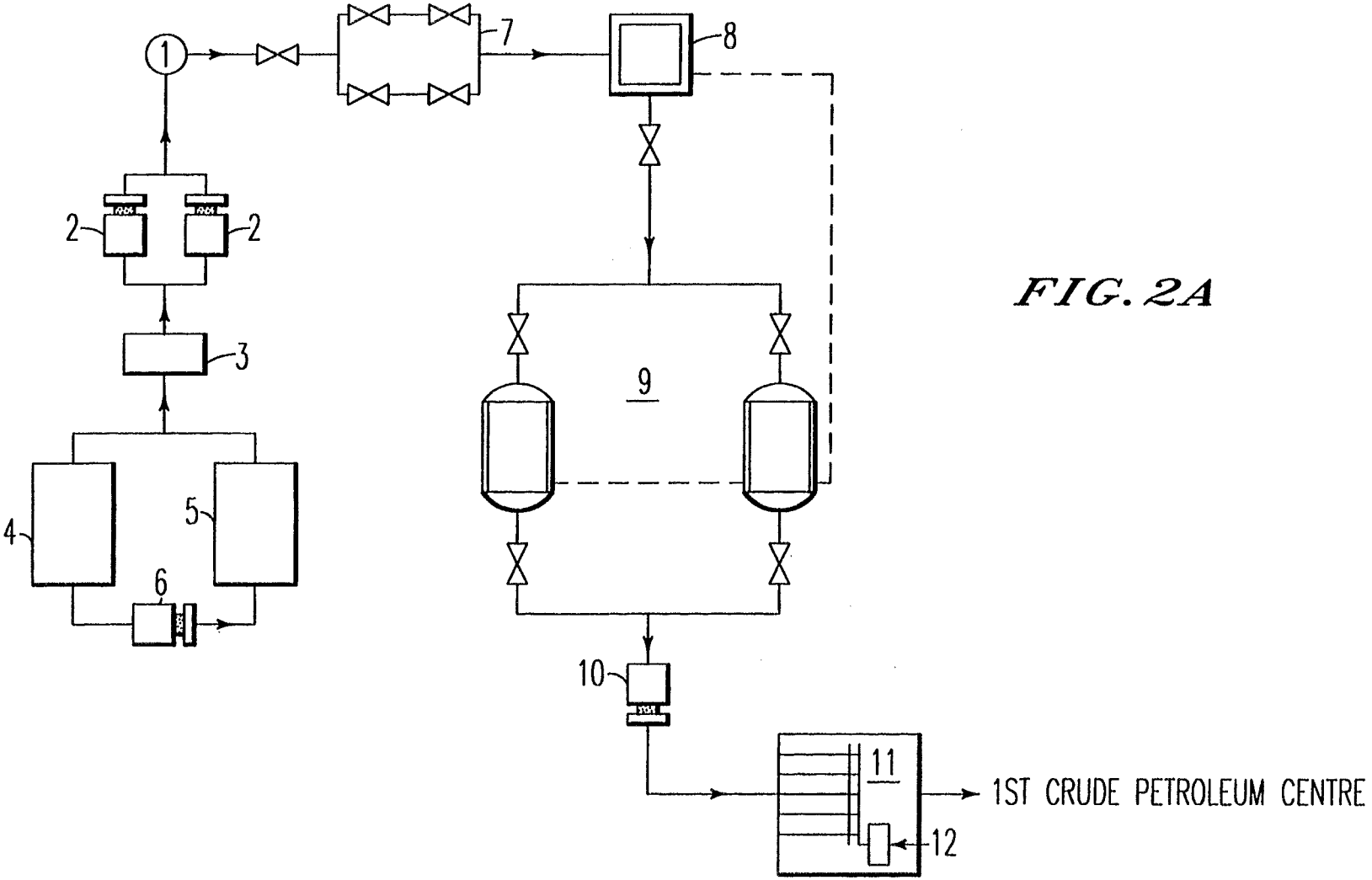
FIG. 2A is a schematic flow surface layout for the production of crude petroleum as in oil and water dispersion.
Figure 2B:
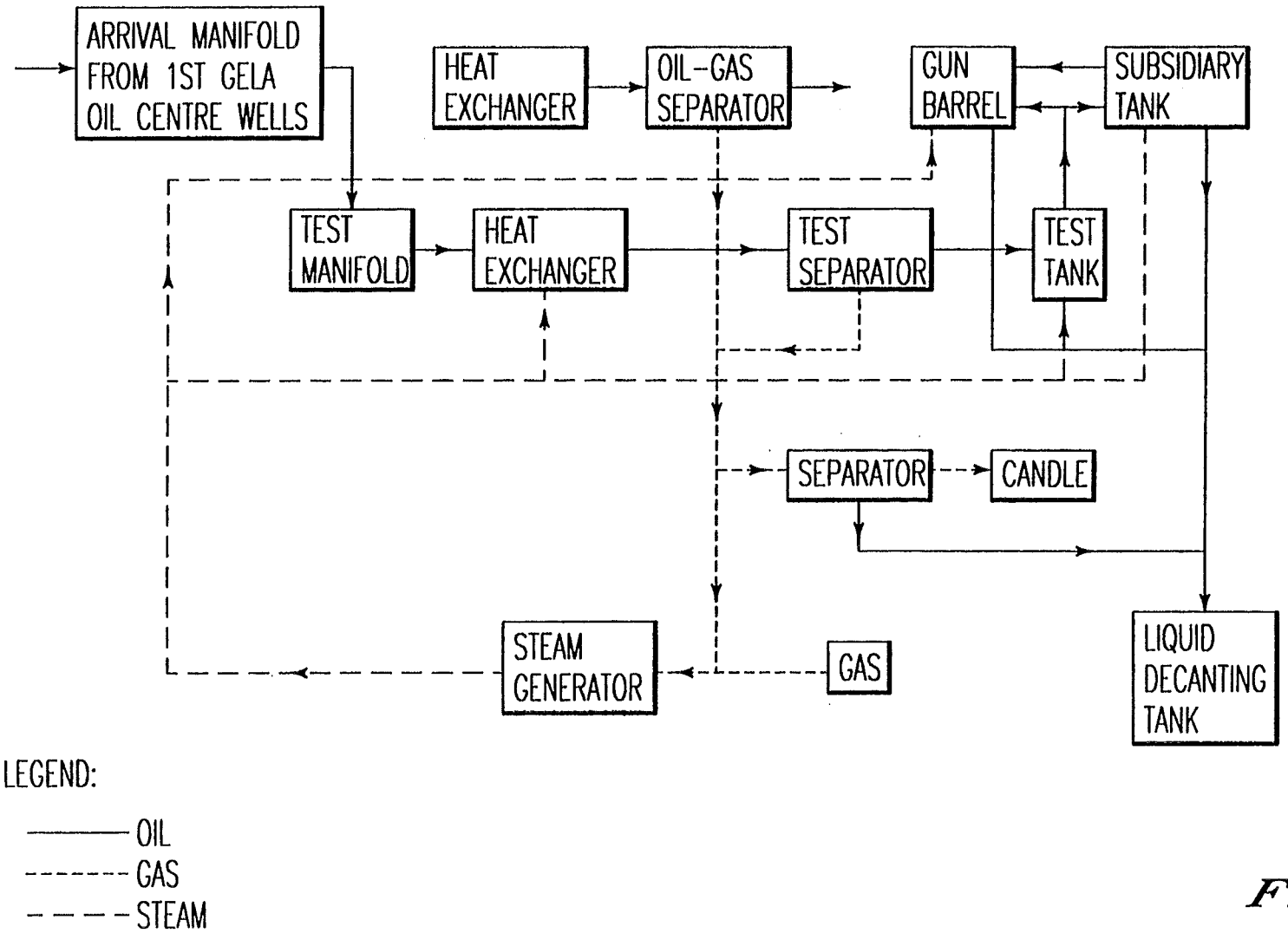
FIG. 2B is a schematic flow diagram of GELA 1ST crude petroleum center.

The surface facility is schematically displayed in FIGS. 2*a* and 2*b*

FIG. 2*a*, is a schematic illustration of a surface layout. According to FIG. 2*a*, commercial solution DNM SH40 is pumped from a storage tank (4) through pump (6) into the water/DNM SH40 solution preparation tank (5). Subsequently, the water solution (DW) is transferred to the water dispersion tank (3). Injection pumps (2) are used to inject the water solution to the well head (1) where the crude oil is dispersed in the water solution. The water/DNM SH40/oil dispersion is then transferred through choke manifolds (7) and a heater (8) to twin measurement tanks (9). From there the dispersion is pumped through pump (10) to a unit comprising a cluster (11) and a water cut meter (12). From there the crude oil is transferred into the 1st crude petroleum center.

FIG. 2*b* is a flow diagram of GELA 1st crude petroleum center.

In the following, the measured parameters, the adopted methods and the test time schedule are disclosed and commented.

MEASURED PARAMETERS

During the tests the following parameters were measured every hour:

Gross throughput;

Flux flow rate (gas oil or DW);

Wellhead temperature and pressure;

Water cut;

Furthermore, a sample of produced fluid was withdrawn every 6 hours and was evaluated for:

Viscosity:

Water cut;

% Level of light species.

The % level of light species/gas oil in the samples collected every 6 hours was measured by stripping. The evaluation of the % content of gas oil flux in the crude oil produced during the test was carried out by comparison with a flux-free crude oil sample.

The water cut was measured by the Marcusson method.

The measurements of viscosity were carried out by using the rotational viscometer Haake RV12 with bob-cup geometry and knurled bob. The flow curve was measured by varying the shear rate value within the range of from 0 to 400 $seconds^{-1}$. Owing to the often macroscopic lack of homogeneity of the collected dispersion samples, all samples were homogenized by using and Ultraturrax turbine at 2000 rpm.

The pumping cycle recording was carried out during every test step by using a dynamometer of mechanical type.

Figure 3:
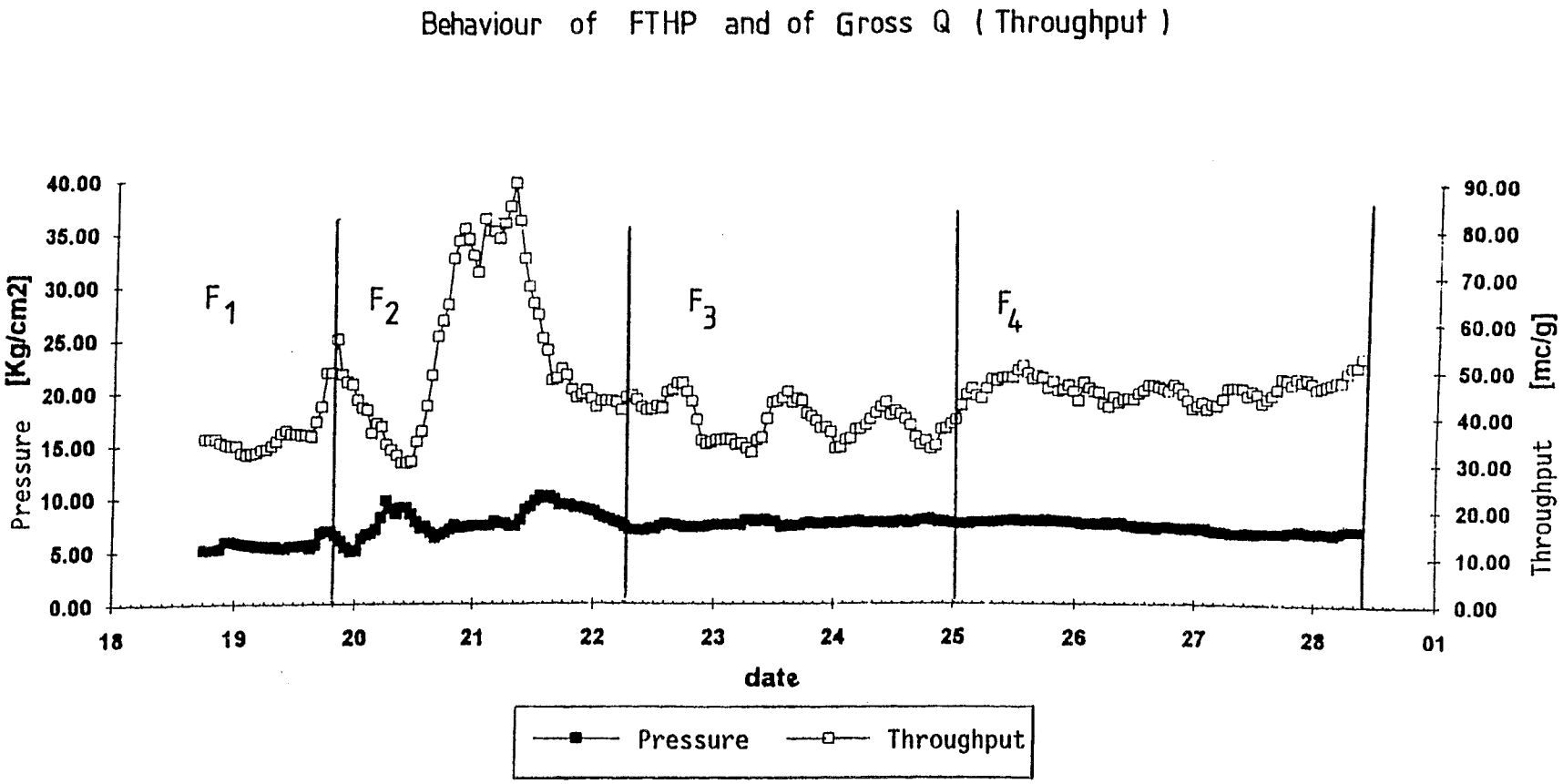
FIG. 3 is a diagram representing the behavior of FTHP and of Gross Q (throughput).
Figure 4:
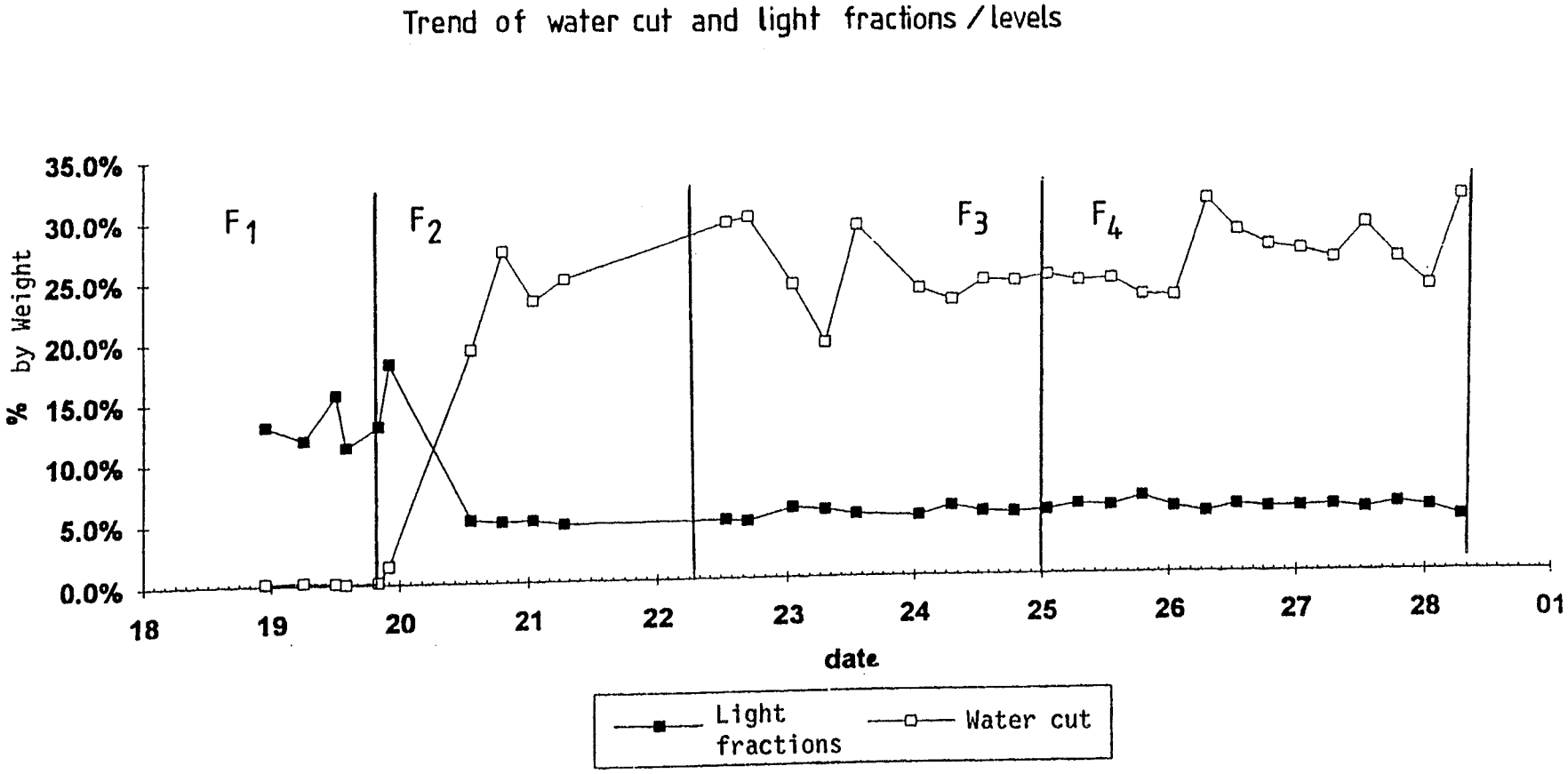
FIG. 4 is a diagram representing the trend of water cut and light fraction/levels over time.
Figure 5:
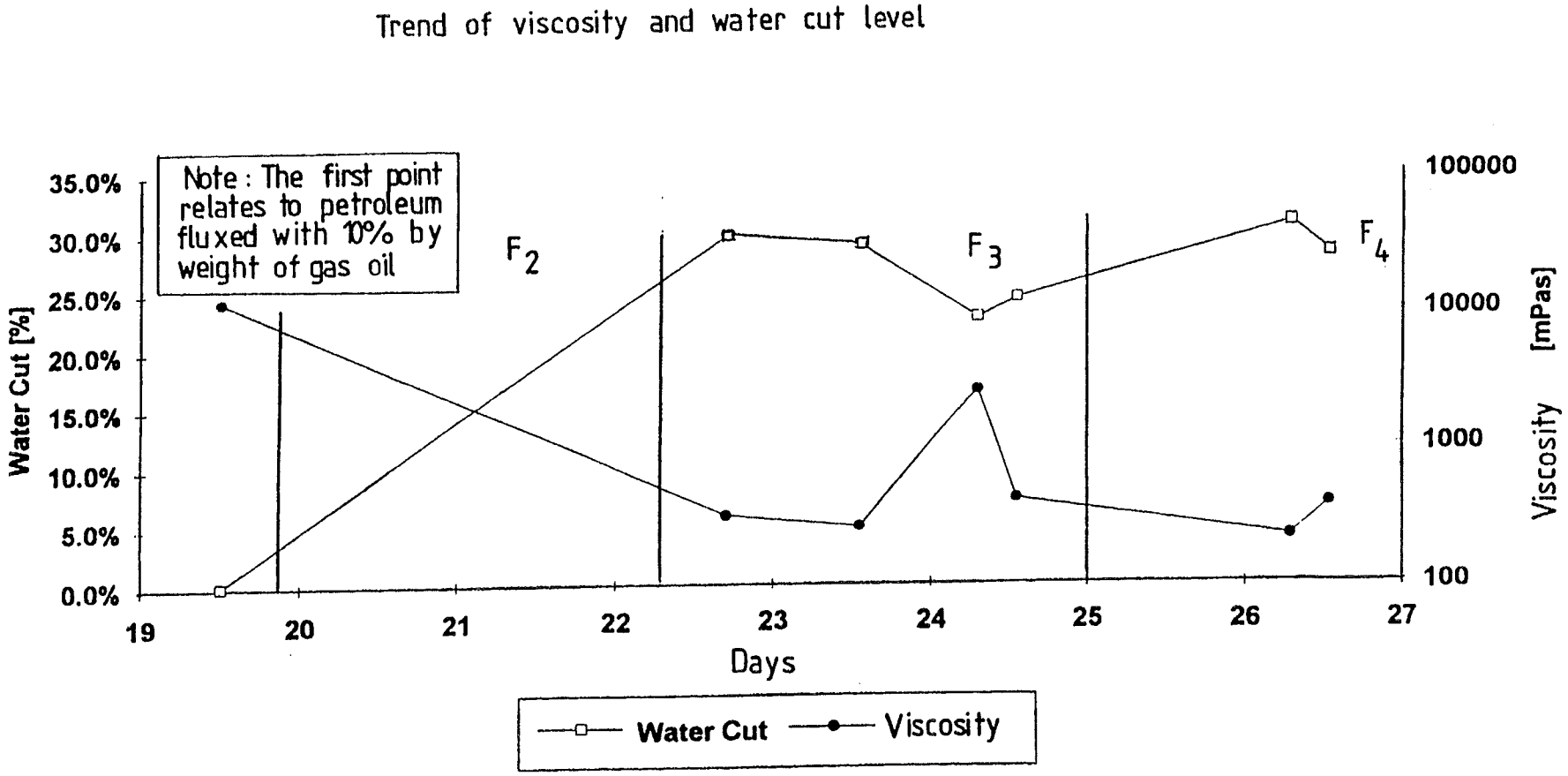
FIG. 5 is a diagram representing the trend of viscosity and water cut level over time.

The trend of the main parameters measured is shown in FIGS. 3, 4 and 5.

TEST TIME SCHEDULE

The test consisted of five steps, during each of which a different delivery situation occurred:

(F1) Well under pumping, fluxed with gas oil at approximately 10%;

(F2) Displacement of the annular fluid (gas oil) by DW 1.2[1]%, injection rate 16 $m^3$ per day;

[1] The flow rate of the dispersant is referred to the total weight of an O/W dispersion with the ratio of 70:30. Therefore, the true concentration of the injected solution can be obtained by multiplying the indicated concentration times 100/30=3.33.

(F3) Well under pumping, fluxed with DW 1.0%, injection flow rate 13.5 $m^3$ per day;

(F4) Well under pumping, fluxed with DW 0.6%, injection flow rate 13.5 $m^3$ per day;

(F5) Well under pumping, not fluxed.

In Table 3 the representative delivery parameters and the properties of the produced fluid are reported for the five test steps.

COMMENTS ON THE TEST

DW solutions at suitable concentrations were prepared as batches of approximately 30 $m^3$ each, by diluting, with fresh water, a sodium naphthalene sulfonate condensed with formaldehyde, supplied as a concentrated solution containing 40% by weight of dispersant.

During the displacement step a DW 1.2% solution was injected at a flow rate of 24 $m^3$ per day. The concentration excess and the high flow rate value imposed during this step has the precautional purpose of making available a certain amount of additive which would be capable of modifying the wettability of the walls of the production tubing.

The strong increase in production rate (FIG. 3) occurred during the displacement of the gas oil inside the annulus may be attributed to the extremely good rheological characteristics of the O/W dispersion obtained during this step. In fact, the values of injected DW flow rate (24 $m^3$ per day) and of recovered product flow rate (on an average, 70 $m^3$ per day) indicate an O/W ratio of about 65:35, corresponding to a lower viscosity than 150 mPa.s, i.e., about 80 times lower than of the oil fluxed with gas oil.

Owing to the sudden increase of oil production by the well, the wellhead choke was partially closed in order not to risk an increase in stratum water throughput. The test was continued with the wellhead choke being partially closed.

The trend of the viscosity of the produced fluid over time, is reported in FIG. 5, together with the trend of contained water. It should be stressed the positive outcome that for all reported O/W ratios, to the wellhead always a fluid dispersion arrived. In particular, even for O/W ratios of 80:20, the external phase was always water and the rheological properties remained, for all analysed samples, better than as obtainable by means of the dilution with gas oil.

In order to evaluate the fluxing effectiveness, we regarded it suitable to describe the test trend by means of the wellhead productivity index ($PI_{head}$), defined as the following ratio:

$$PI_{head}=Q_{oil}/(STHP-FTHP)$$

wherein:

$Q_{oil}$ is the net oil flow rate,

STHP is the static wellhead pressure, and

FTHP is the flowing wellhead pressure.

Figure 6:
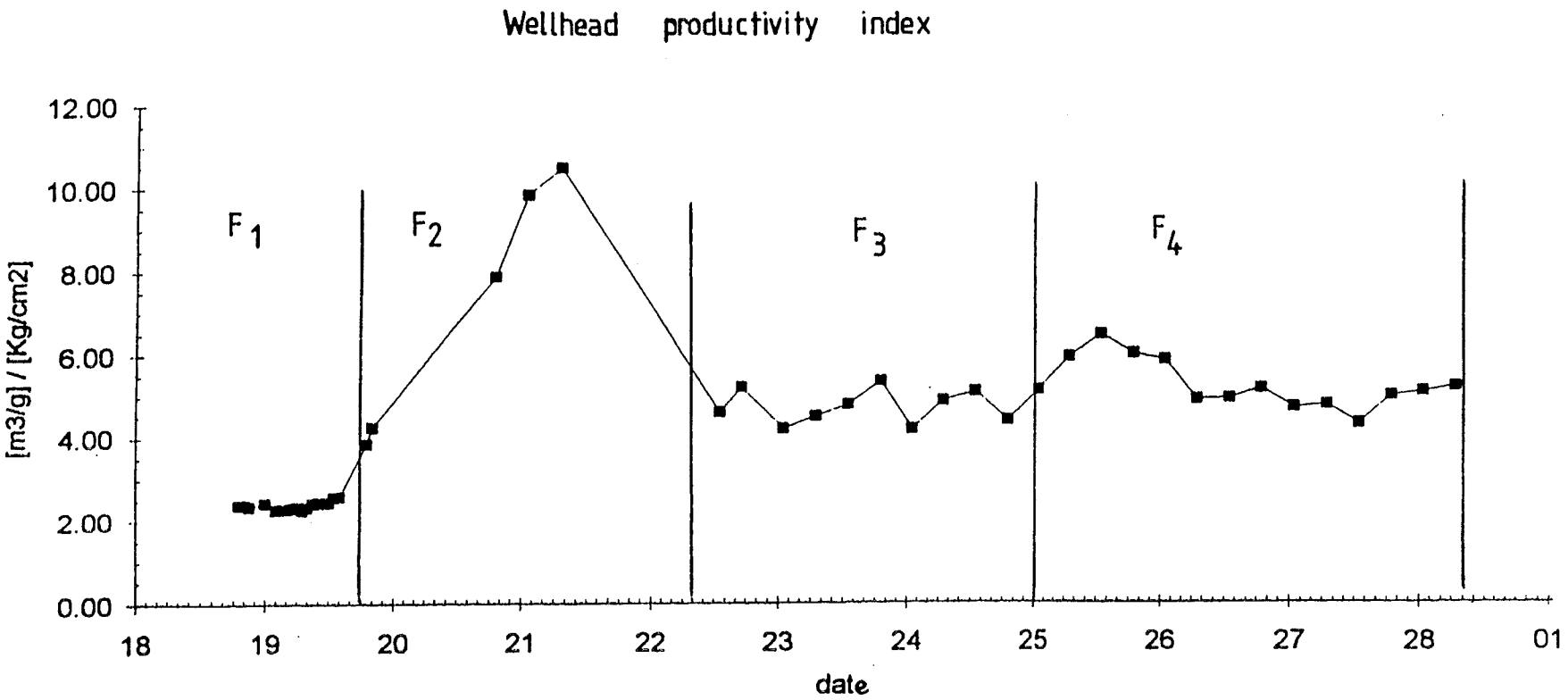
FIG. 6 is a diagram representing the well head productivity index over time.

For each test step, the static pressure STHP was recalculated on the basis of the hydrostatic pressure of the fluid contained inside the tubing. From the behaviour of $PI_{head}$ during the several test steps, reported in FIG. 6, the increase in productivity can be clearly seen which was induced by the system fluxing with DW. The net oil productivity was doubled when the gas oil fluxed system—$PI_{head}$=2.5 ($m^3$/day)(kg/$cm^2$)—was replaced by the dispersed system with 1% of dispersant by weight—$PI_{head}$=4.5 ($m^3$/day)(kg/$cm^2$). A further increase in productivity was obtained when the dispersion was produced with 0.6% of dispersant by weight: $PI_{head}$=5 ($m^3$/day)(kg/$cm^2$).

The dynamometric analysis evidenced that both during the oil fluxing with gas oil, and with the DW, the well delivered spontaneously, whilst when no flux was present [Step (F5)], the pump supplied work. This matter of fact is also confirmed by the volumetric efficiency behaviour, in the values of which increases were observed of 100% in the presence of flux (either DW or gas oil) and, respectively, of 80% with flux free oil. Anyway, from the dynamometric records a meaningful difference between the performane of the pump in the presence of both fluxing systems (with gas oil or with DW) could not be observed, It is worth while observing that the viscosity of the dispersion is affected to a much lower extent by temperature, as compared to the viscosity of the product fluxed with gas oil. Such a feature is evidenced by the behaviour of viscosity with varying temperatures within the range of from 25° to 55° C. for both systems, which is reported in FIG. 7.

CONCLUSIONS

The field test enabled the possibility of both producing and transporting crude petroleum as a dispersion of oil in water admixed with the dispersant according to the present invention, to be checked with positive outcome. In particular, the following conclusions may be drawn.

Feasibility of Crude Oil Production

The mechanical mixing action performed by the rod pump and the injection of the aqueous solution into the annulus resulted to be sufficient in order to form and produce a fluid dispersion, The viscosity of the dispersion with O/W ratio=70:30% by weight resulted to be 30–50 times lower than of petroleum diluted with gas oil at 10–12% by weight (250–400 mPa.s, vs. about 12,500 mPa.s);

Even in the case of O/W ratios close to 80:20% by weight, the well leaving product retained its character of an O/W dispersion, and displayed better rheological properties than of gas oil fluxed petroleum;

The considerable decrease in viscosity obtained when the system was converted from a gas oil fluxed one into the dispersed system, caused a considerable decrease in pressure drop along the tubing which in its turn yielded, thanks to the high productivity index of the well, the observed increase in net petroleum production from 30 $m^3$/day up to peak values of more than 100 $m^3$/day. The production was decreased back to its initial values by acting on the wellhead choke;

The productivity of the well sharply increased when the $PI_{head}$ value was increased from 2.5 ($m^3$/day)(kg/$cm^2$) up to 5 ($m^3$/day)(kg/$cm^2$).

The rheological characteristics of the produced dispersion and the $PI_{head}$ value resulted to be better when the dispersant additive was used at a level of 0.6% by weight, than at 1% by weight.

Transport Ability of the Dispersion Inside the Flow Line

The good rheological properties of the O/W dispersion caused a considerable decrease in pressure drop values also in the flow line from the well to the Petroleum Stock Centre, about 1 km long. In fact, the pressure drop decreased from the value of 3 kg/cm$^2$ at a flow rate of 34 m$^3$/day (gas oil fluxed system), down to a PD=0.5 kg/cm$^2$ at a flow rate of 43 m$^3$/day (in the case of the dispersed system).

Figure 7:
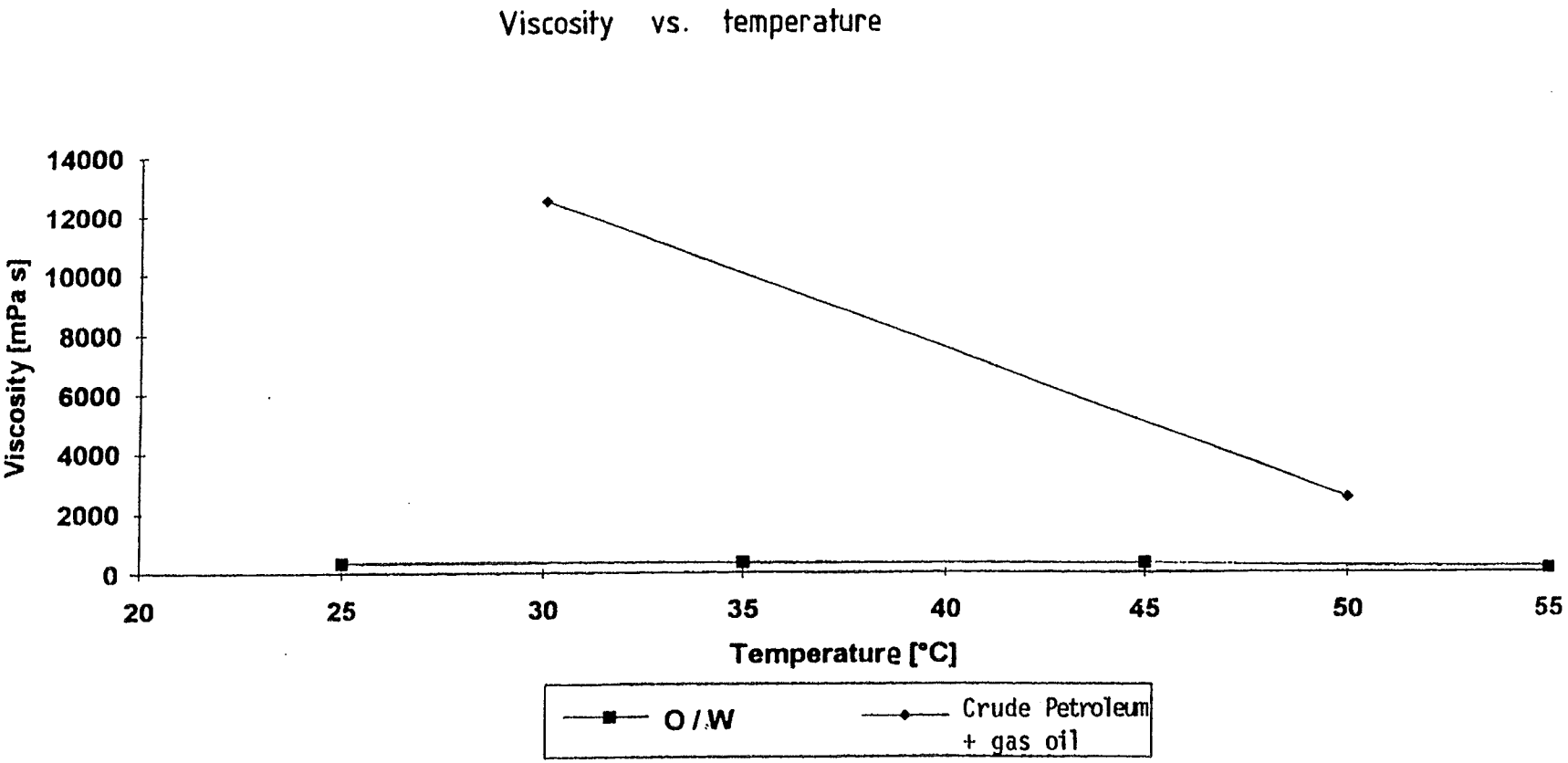
FIG. 7 is a diagram representing viscosity versus temperature.

The viscosity of the O/W dispersion resulted to be much less sensible to temperature changes, than of the petroleum diluted with gas oil (FIG. 7).

TABLE 3

Comparison Data Relevant to Products and Well Situations

| | F1 | F3 | F4 | F5 |
|---|---|---|---|---|
| Preset delivery parameters | | | | |
| Pump stroke (inches) | 70 | 85 | 85 | 85 |
| Pump strokes/minutes | 3.32 | 3.32 | 3.32 | 3.32 |
| Theoretical delivery (m$^3$/d) | 28 | 39.5 | 39.5 | 39.5 |
| Flux pressure (kg/cm$^2$) | 43 | 29 | 26 | — |
| Actual delivery parameters | | | | |
| Gross throughput (m$^3$/d) | 42 | 64.8 | 43.2 | 30 |
| THP (kg/cm$^2$) | 4.2 | 7.2 | 6.2 | 16 |
| THT (°C.) | 26.5 | 20 | 21 | — |
| Produced fluid | | | | |
| Light fractions (% by weight) | 15.6 | 4.6 | 5.4 | 4.5 |
| Viscosity at 30° C. (mPa.s) | 12500 | 320 | 380 | >40000 |
| Rheological behaviour[1] | N | T | T | N |
| Water cut distillation (% by weight) | 0.1 | 29.8 | 28.1 | 1.5 |
| Transfer to flow line | | | | |
| Gross throughout (m$^3$/d) | 34 | 43 | — | 30 |
| Pressure drop (kg/cm$^2$) | 3 | 0.5 | — | 10 |

F1: Crude petroleum sample OG105 collected on Feb. 19th, 1993 at 12:00 a.m.; flux: gas oil
F3: Crude petroleum sample OG105 collected on Feb. 22nd, 1993, at 5:00 p.m.; flux: DW 1%
F4: Crude petroleum sample OG105 collected an Feb. 26nd, 1993, at 1:00 p.m.; flux: DW 0.6%
F5: Crude petroleum sample OG105 collected on March 3rd, 1993 after about 48 hours without flux.
[1]N = Newtonian fluid (viscosity independent from shear rate).
T = Thixotropic fluid (decreasing viscosity with increasing shear rate or over time under fixed shear rate conditions).

LEGEND IN RESPECT OF FIG. 2*a*

1-Wellhead
2-DW injection pumps
3-DW transfer tank
4-Storage tank for the commercial solution of DNM SH40
5-DW preparation tank
6-Pump for water/DNM SH40 preparation solution
7-Choke manifold
8-Heater
9-Twin measurement tanks
10-Pump for transfer of produced fluid to the 1st C.R.O. (Crude Petroleum Centre)
11-Cluster
12-Water cut meter

We claim:

1. Process for recovering and causing highly viscous petroleum products to move, characterized in that the above said high-viscosity petroleum products are recovered and caused to flow as aqueous dispersions wherein the water content of said dispersions is of at least 15%, said dispersions being formed by bringing said high-viscosity petroleum products into contact with an aqueous solution of a sulfonated dispersant selected from one or more of alkali metal or ammonium organic sulfonates having, with reference to the sodium salts of said sulfonates, the following properties:

(A) a sulfur content of at least 10%
(B) a water solubility at 20° C. of at least 15% by weight;
(C) a decrease in water surface tension, at a concentration of 1% by weight, not higher than 10%.

2. Process according to claim 1, in which the dispersant has the following properties:

(A) a sulfur content comprised within the range of from 11 to 18%;
(B) a water solubility at 20° C. comprised within the range of from 20 to 60%; weight;
(C) a decrease in water surface tension, at a concentration of 1% by weight, not higher than 8%.

3. Process according to claim 1 or 2, in which the dispersant is selected from the salts of alkali metals or ammonium of condensates of (alkyl) naphthalene sulfonic acid with formaldehyde.

4. Process according to claim 1 or 2 in which the dispersant is selected from one or more of sodium or ammonium sulfonates obtained by:

bringing sulfur trioxide in either liquid or gas form, into contact with a solution of fuel oil from steam cracking in $SO_2$, with a ratio, by weight, of $SO_3$ to fuel oil comprised within the range of from 0.7:1 to 1.7:1 and a ratio, by weight, of $SO_2$:$SO_3$ comprised within the range of from 0.5:1 to 10:1, at a temperature comprised within the range of from 0° to 120° C., until a complete or substantially complete conversion of $SO_3$ is obtained;

removing, by evaporation, sulfur dioxide from the sulfonated fuel oil;

neutralizing the sulfonated fuel oil with an aqueous solution of an alkali metal or ammonium hydroxide;

recovering the neutralized sulfonated dispersant.

5. Process according to claim 4, characterized in that the sulfonation step is carried out by operating at a temperature comprised within the range of from 20° to 100° , with a ratio, by weight, of sulfur dioxide to fuel oil comprised within the range of from 0.8:1 to 1.6:1.

6. Process according to claim 1, in which the water content in the dispersion is comprised within the range of from 15 to 40%, based on the total weight of the dispersion.

7. Process according to claim 1, in which the highly viscous petroleum product has a lower gravity than 15° API.

8. Process according to claim 1, in which the amount of dispersant is comprised within the range of from 0.2 to 2.5%, relatively to the total weight of the dispersion.

9. Process according to claim 8, in which the amount of dispersant is comprised within the range of from 0.4 to 1.5%, relatively to the total weight of the dispersion.

10. Pumpable dispersion of a very viscous petroleum residue in water, which comprises 60–85% of a very viscous petroleum product, one or more dispersants according to claim 1 in an amount comprised within the range of from 0.2 to 2.5%, the balance to 100% being water.

11. Pumpable composition according to claim 10, in which the dispersant is contained in an amount comprised within the range of from 0.4 to 1.5%.

* * * * *